US007156135B1

(12) United States Patent
Yeh

(10) Patent No.: US 7,156,135 B1
(45) Date of Patent: Jan. 2, 2007

(54) QUICK-RELEASE CONNECTOR STRUCTURE FOR AN AIR TANK

(75) Inventor: Hsin-Cheng Yeh, Yung Kang (TW)

(73) Assignee: Sunworld Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 11/344,253

(22) Filed: Feb. 1, 2006

(51) Int. Cl.
*B65B 1/04* (2006.01)

(52) U.S. Cl. ..... 141/301; 251/260; 251/149.6; 137/512.2

(58) Field of Classification Search ..... 141/301, 141/302, 38; 251/260–263, 149.6, 149.9
See application file for complete search history.

(56) References Cited

U.S. PATENT DOCUMENTS 4,470,428 A * 9/1984 Bishop et al. ..... 137/115.15
6,631,880 B1 * 10/2003 Kandel ..... 251/14
2005/0274830 A1 * 12/2005 Gilmore et al. ..... 239/569
2006/0032647 A1 * 2/2006 Petty ..... 173/169

* cited by examiner

*Primary Examiner*—Steven O. Douglas
(74) *Attorney, Agent, or Firm*—Rosenberg, Klein & Lee

(57) ABSTRACT

A quick-release connector structure for an air tank includes a connector body incorporated with an air tank and a seat block. The seat block is secured to the air tank and comprises a valve having a post extending forwardly. The valve is acting as a switch to turn the air tank on and off. The connector body comprises a first passage and a second passage. The first passage comprises an air release hole and a through hole. A thimble is disposed in the first passage. A quick-release wrench is provided in a recess disposed on the connector body. The quick-release wrench corresponds to the through hole and is secured by a fastener. By turning the quick-release wrench, the high-pressure air remaining in the pipe is released.

5 Claims, 7 Drawing Sheets

QUICK-RELEASE CONNECTOR STRUCTURE FOR AN AIR TANK

BACKGROUND OF THE INVENTION

1. Field of the Invention

This invention relates to a quick-release connector structure, and more particularly to a connector body able to detach from an air tank in a fast and safe way by means of a quick-release wrench to release high-pressure air remaining in the pipe.

2. Description of the Prior Art

A conventional connector comprises an air passage having one end connected to a pressure gauge and another end connected to a pressure pipe. The connector is sleeved onto an open end of an air tank to control airflow. However, when replacing the air tank, some shortcomings may happen:

1. The high-pressure air remaining in the pipe may cause air pop out;
2. The high-pressure air remaining in the pipe will make disconnection of the connector and the air tank more difficult.

SUMMARY OF THE INVENTION

It is the primary object of the present invention to provide a quick-release connector structure for an air tank, which can release high-pressure air remaining in the pipe for easy disconnection of the connector body with the air tank.

It is another object of the present invention to provide a quick-release connector structure for an air tank, which is safe to disconnect the connector body from the tank.

DETAILED DESCRIPTION OF THE PREFERRED EMBODIMENT

Figure 1:
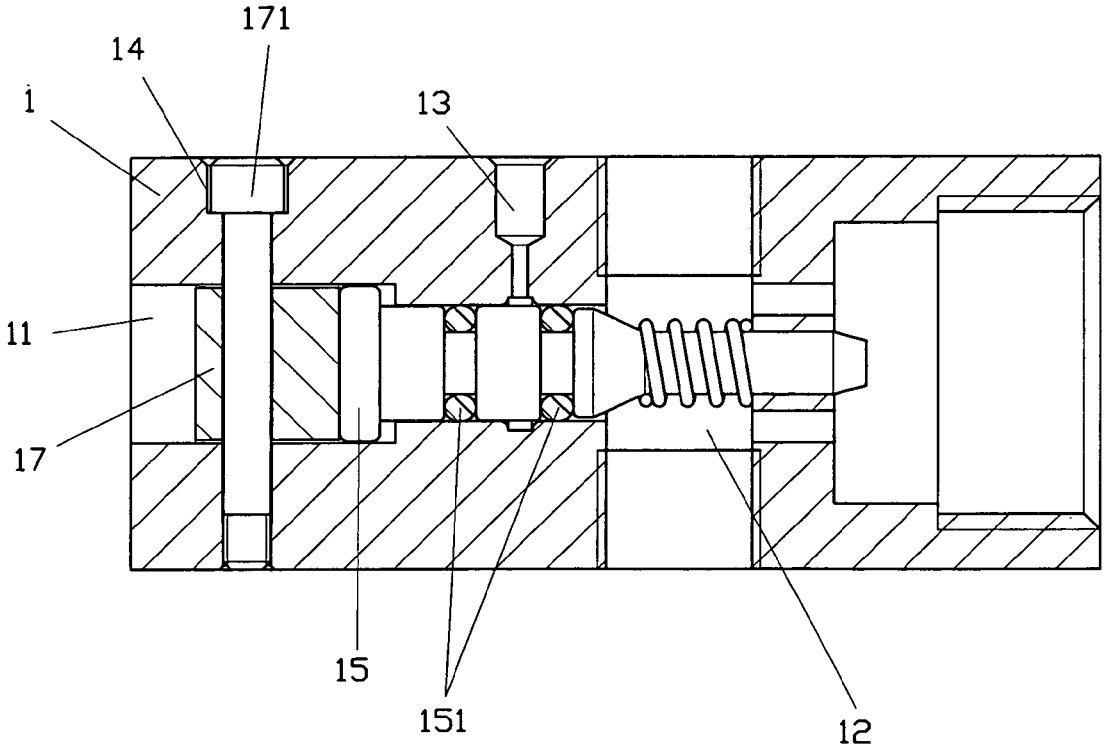
FIG. 1 is a first cross-sectional view of a connector body of the present invention.
Figure 2:
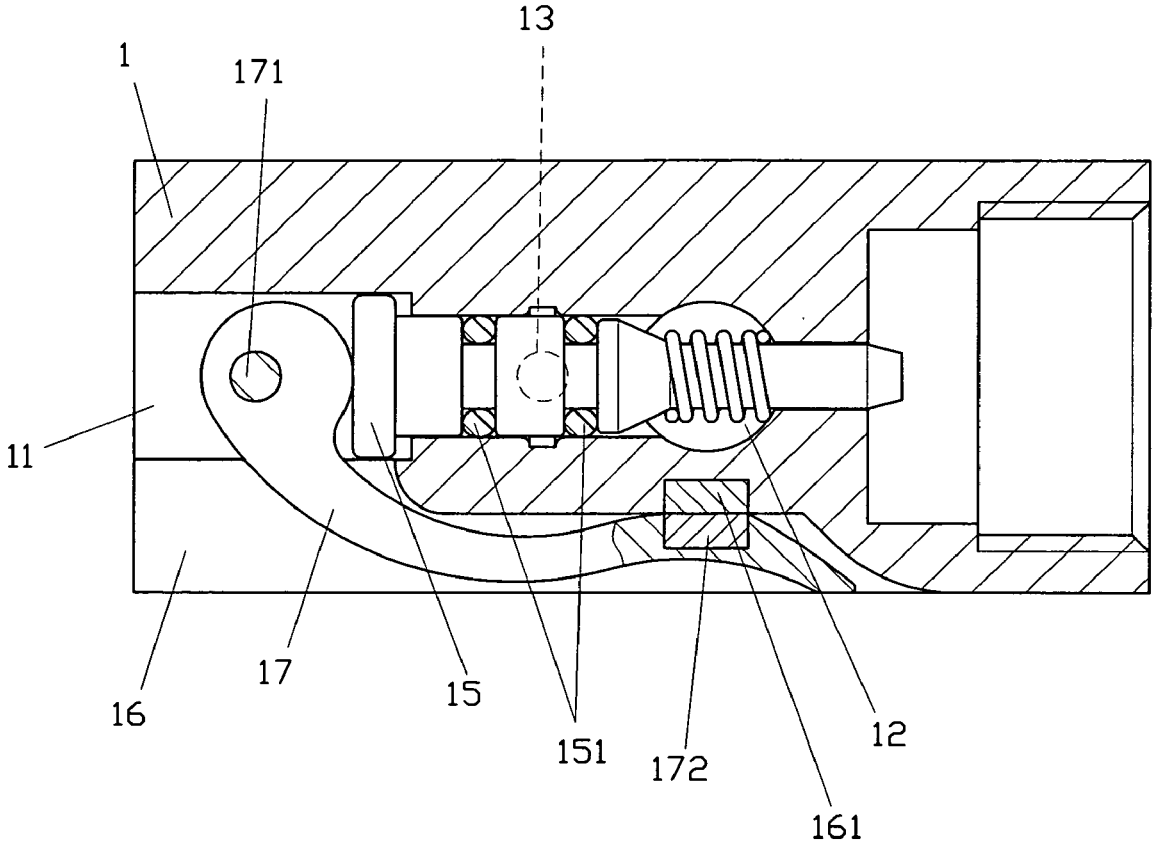
FIG. 2 is a second cross-sectional view of the connector body of the present invention.

As shown in FIGS. 1 and 2, the present invention comprises a connector body 1 having a first passage 11 and a second passage 12, an air release hole 13, and a through hole 14. The first passage 11 is interconnected with the second passage 12. A thimble 15 is disposed in the first passage 11. The air release hole 13 and the through hole 14 are interconnected with the first passage 11. A recess 16 is disposed to the connector body 1 to accommodate a quick-release wrench 17 therein. A magnetized member (or a magnetic member) 161 is disposed in the recess 16. The quick-release wrench 17 has a fastener 171 and a magnetic member (or a magnetized member) 172. The quick-release wrench 17 corresponds to the through hole 14 of the connector body 1 for securing purpose through the fastener 171. The magnetized member 161 of the recess 16 is magnetized to the magnetic member 172 of the quick-release wrench 17.

Figure 3:
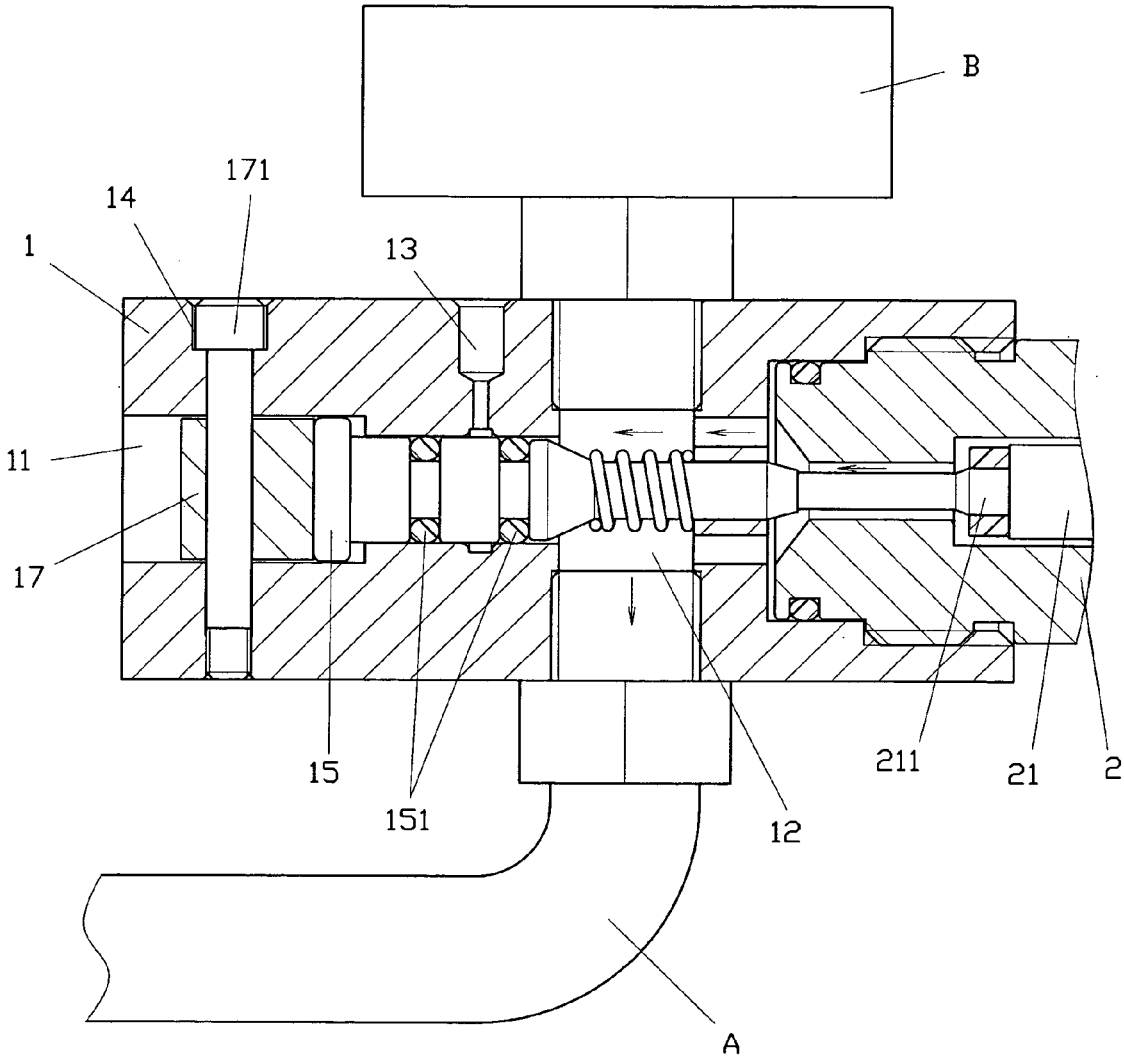
FIG. 3 is a first cross-sectional view of the present invention showing air pumped into the connector body.
Figure 4:
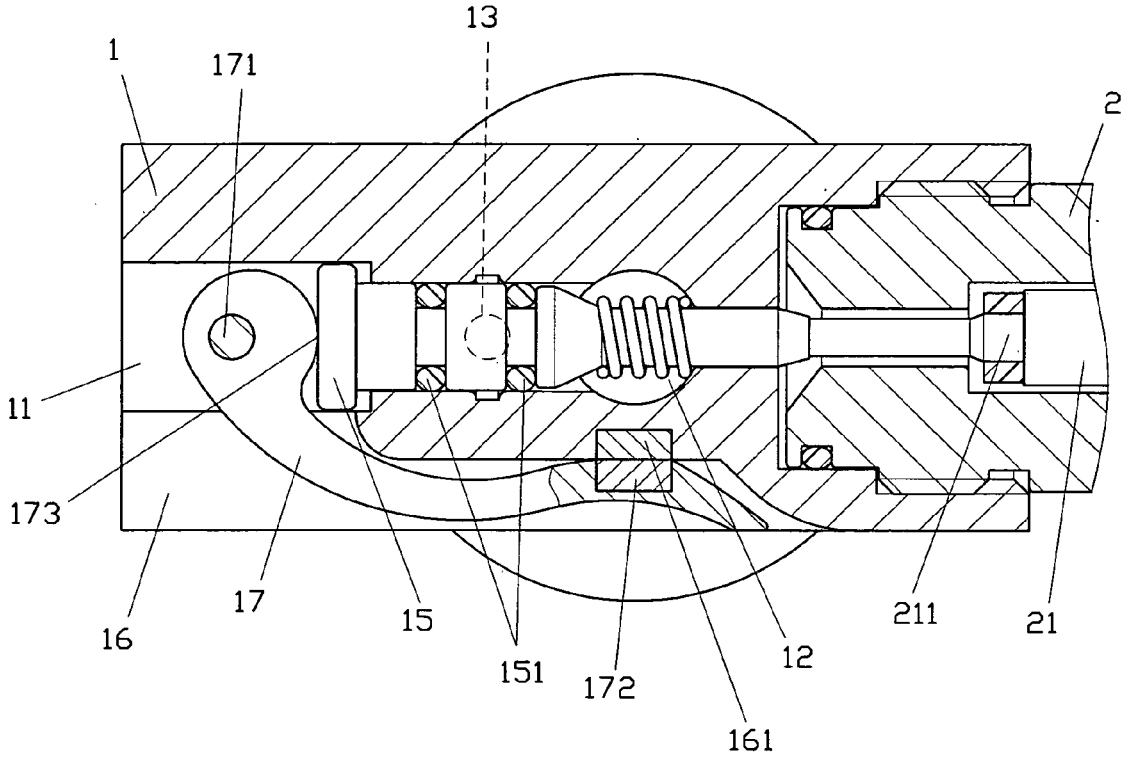
FIG. 4 is a second cross-sectional view of the present invention showing air pumped into the connector body.

The connector body 1 is assembled to a seat block 2, as shown in FIGS. 3 and 4. A pressure end 173 of the quick-release wrench 17 engages with and urges the thimble 15 towards a post 211 of a valve 21 of the seat block 2. This forces the post 211 to slide. Whereas the first passage 11 of the connector body 1 and the seat block 2 have produced a gap in between and air pressure may be forced from there and into a pressure pipe A and a pressure gauge B provided on the second passage 12. Because the thimble 15 is urged by the quick-release wrench 17, a worm ring 151 on the thimble 15 will slide away from the air release hole 13, thus air can not be released from the air release hole 13 and remains in the second passage 12.

Figure 5:
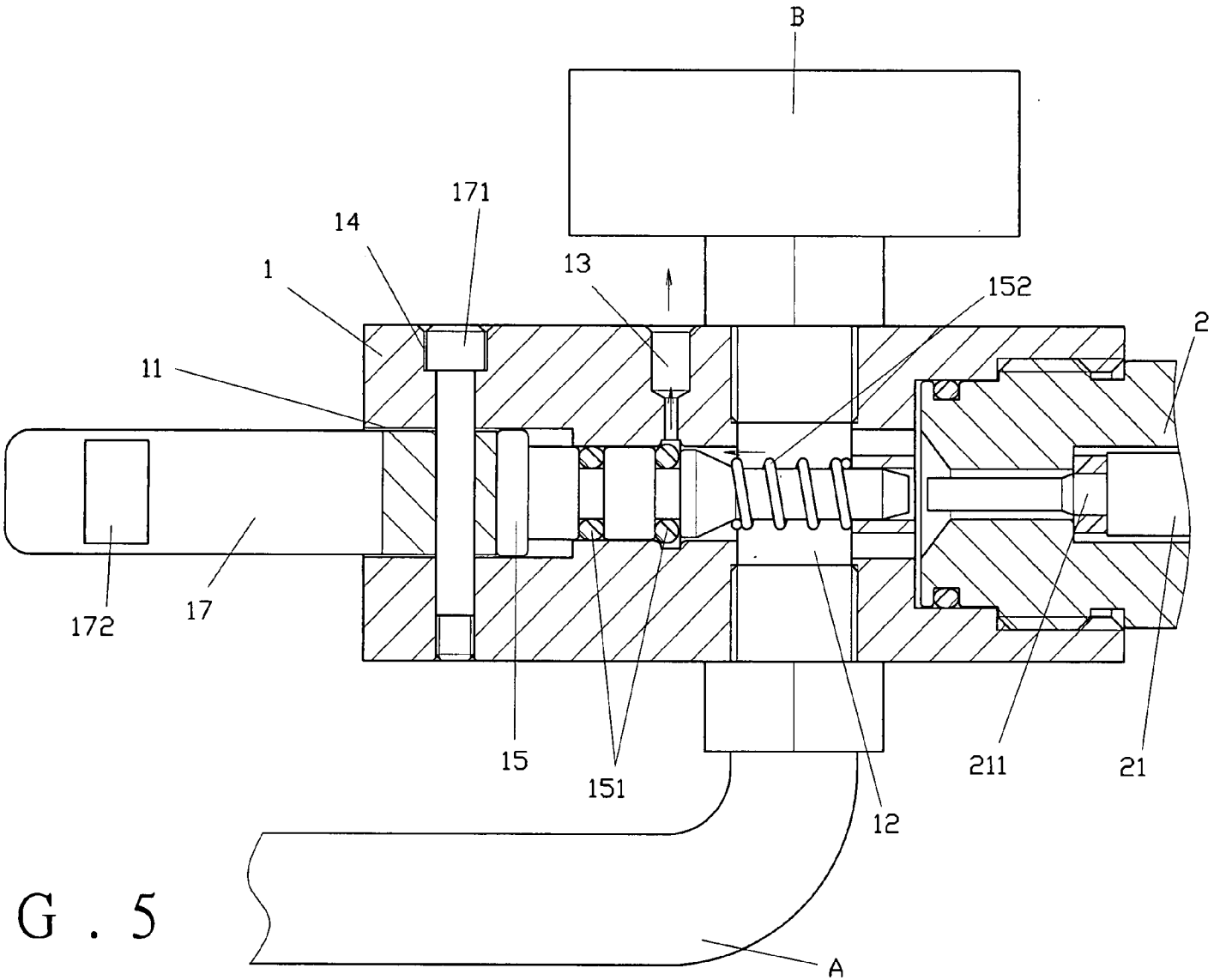
FIG. 5 is a first cross-sectional view of the present invention showing air released through an air release hole.
Figure 6:
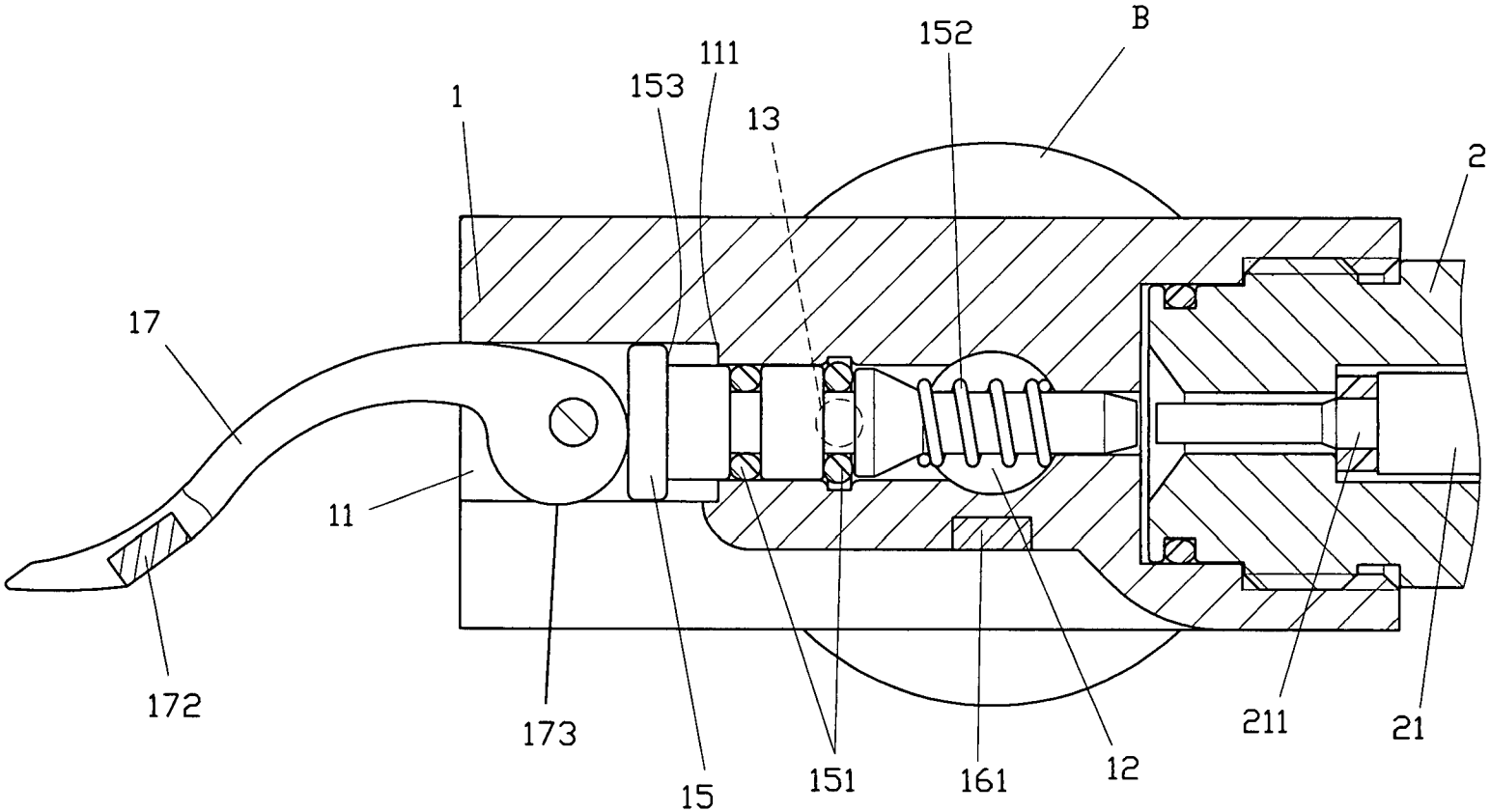
FIG. 6 is a second cross-sectional view of the present invention showing air released through the air release hole.

To release the remaining air, as shown in FIGS. 5 and 6, the quick-release wrench 17 is turned to disengage the magnetic member 172 from the magnetized member 161, which moves the pressure end 173 of the quick-release wrench 17 away from the thimble 15. An elastic element 152 of the thimble 15 pushes the thimble 15 back to its original position, which forms a gap between the worm ring 151 of the thimble 15 and the air release hole 13, thus the remaining air in the pressure gauge B of the second passage 12 will be released through the air release hole 13 so as to balance the pressure of the outside and the connector body 1. Thus the pressure pipe A can be separated. The gap between a blocking edge 153 of the thimble 15 and a blocking wall 111 of the first passage 11 may be placed with washers to adjust the extending length of the thimble 15.

Figure 7:
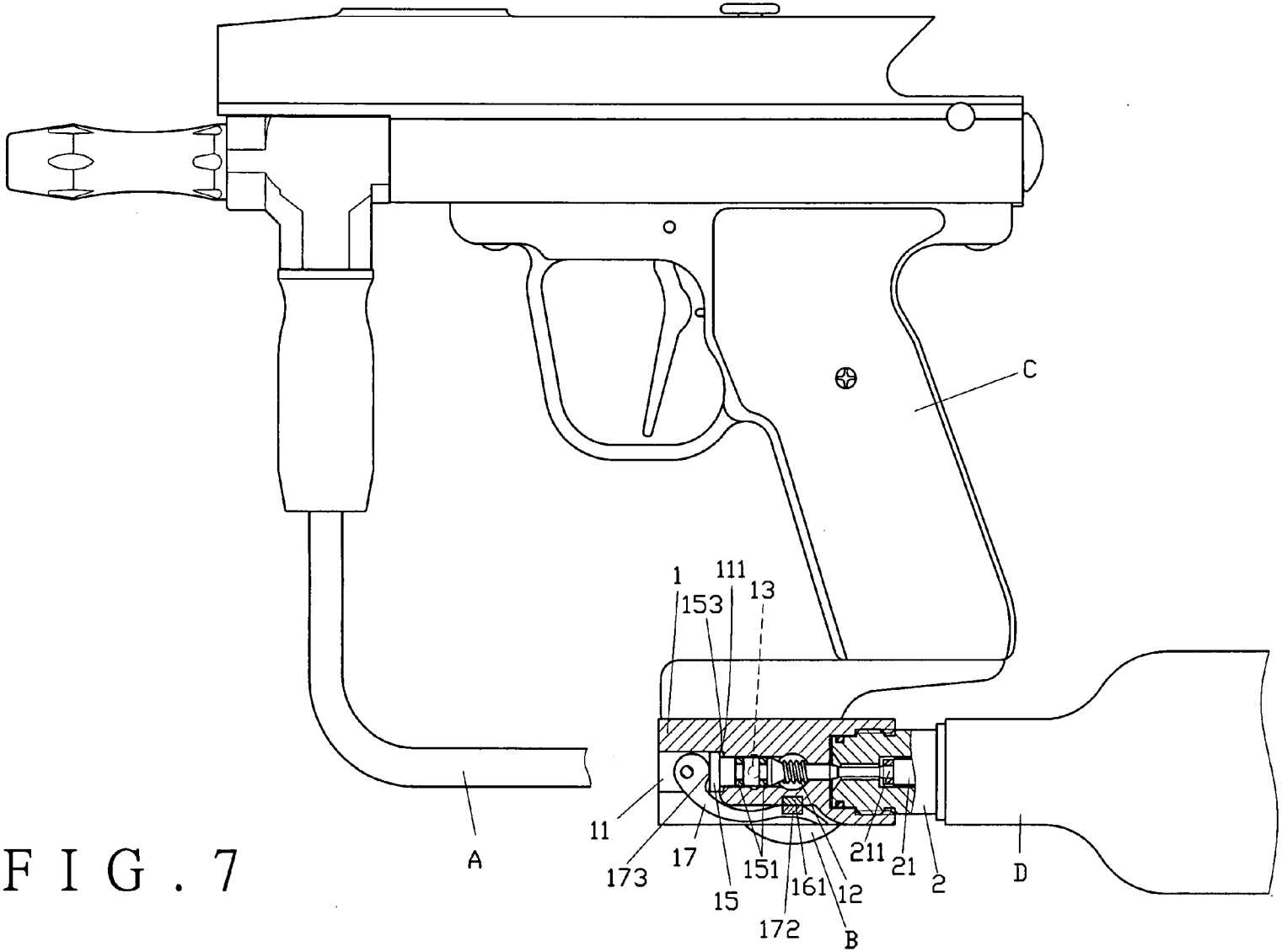
FIG. 7 is a cross-sectional view of the present invention incorporated with a paintball gun and an air tank.

When the present invention is incorporated with a paintball gun C and an air tank D, as shown in FIG. 7, the seat block 2 is secured to the air tank D and adapted to connect with the connector body 1. The quick-release wrench 17 is forced so that the magnetic member 172 is magnetized with the magnetized member 161 of the recess 16. The pressure end 173 engages with the thimble 15 and urges the thimble 15 to move toward the post 211, which links the post 211 of the valve 21 to slide simultaneously. Whereas the thimble 15 blocks the air release hole 13, air from the air tank D is allowed to flow to the second passage 12 of the connector body 1. Upon the usage is completed, the quick-release wrench 17 is turned so that the pressure end 173 of the quick-release wrench 17 disengages from the thimble 15, which brings the thimble 15 back to its original position. The worm ring 151 of the thimble 15 corresponds to the air release hole 13 to form a gap, thus the remaining air in the pressure gauge B of the second passage 12 will be released through the air release hole 13 to balance the air pressure of both inside and outside of the connector body 1. It is easy to detach the pressure pipe A, preventing any air explosion, when changing the paintball gun C.

A gap is formed between the blocking edge 153 of the thimble 15 and the blocking wall 111 of the first passage 11 for replacing the air tank D. In any event that a replaced air tank has a different size, the valve 21 in the seat block 2 may be varied, the gap from above allows the user to insert washers so as to adjust the extending length of the thimble 15.

What is claimed is:

1. A quick-release connector structure for an air tank comprising a connector body incorporated with an air tank and a seat block, said seat block comprising a valve to turn said air tank on and off, said valve comprising a post therein, said connector body being secured to said seat block and comprising a first passage and a second passage interconnected with said first passage, said first passage comprising a thimble therein, and characterized by:

said connector body comprising an air release hole and a quick-release wrench, said thimble in said first passage being linked with said quick-release wrench to slide within said first passage, when said thimble in said first passage engages with said post of said valve of said seat block, said air tank being in an open status and said air release hole being blocked, when said thimble disengages with said post of said valve of said seat block, said air tank being in a closed status and said first passage interconnecting with said air release hole.

2. The quick-release connector structure for an air tank, as recited in claim 1, wherein said connector body further comprises a recess to receive said quick-release wrench therein.

3. The quick-release connector structure for an air tank, as recited in claim 2, wherein said recess comprises a magnetized member, and said quick-release wrench comprises a magnetic member.

4. The quick-release connector structure for an air tank, as recited in claim 2, wherein said recess comprises a magnetic member, and said quick-release wrench comprises a magnetized member.

5. The quick-release connector structure for an air tank, as recited in claim 1, wherein a gap is formed between said thimble and said first passage for placing washers therein.

* * * * *